US005779238A

United States Patent [19]

Josa-Patermann

[11] Patent Number: 5,779,238

[45] Date of Patent: Jul. 14, 1998

[54] RECREATIONAL DIDACTIC MULTICOMBINABLE DEVICE

[76] Inventor: Francisco Josa-Patermann, Mas Salvi, s/n, 17256 Pals (Girona), Spain

[21] Appl. No.: 725,095

[22] Filed: Oct. 2, 1996

[51] Int. Cl.[6] ..... A63F 9/08

[52] U.S. Cl. ..... 273/153 S

[58] Field of Search ..... 273/153 S, 153 R, 273/155, 156

[56] References Cited

U.S. PATENT DOCUMENTS

| | | | |
|---|---|---|---|
| 4,557,484 | 12/1985 | Sherman, Jr. et al. | 273/153 S |
| 4,593,908 | 6/1986 | Ibrahim | 273/153 S |
| 4,989,872 | 2/1991 | Urrestarazu Borda | 273/153 S |
| 5,338,033 | 8/1994 | Nunez Serrano | 273/153 S |

FOREIGN PATENT DOCUMENTS

| | | | |
|---|---|---|---|
| 9404235 | 3/1994 | WIPO | 273/153 S |

*Primary Examiner*—Steven B. Wong

*Attorney, Agent, or Firm*—Dennison, Meserole, Pollack & Scheiner

[57] ABSTRACT

A minimal mass preferably spherical nucleus divided in three perpendicular planes forming six sockets and eight triangular hollows. Six guidance organs mount in the sockets and retain seven mobile support parts and one fixed support part received in the triangular hollows and including projecting stems which mount external members.

13 Claims, 11 Drawing Sheets

FIG. 5A
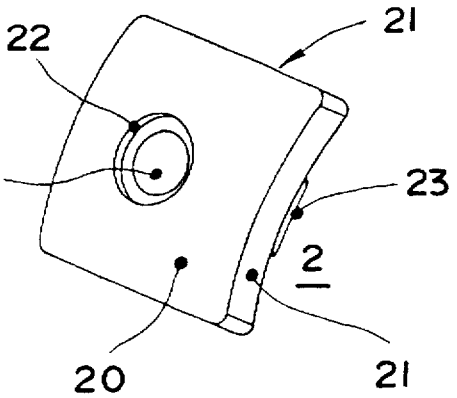
FIG. 5B
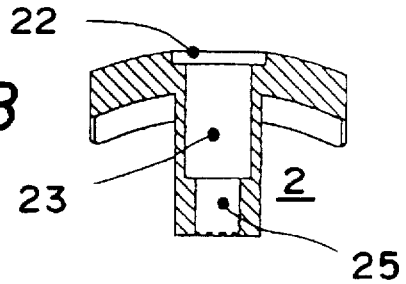
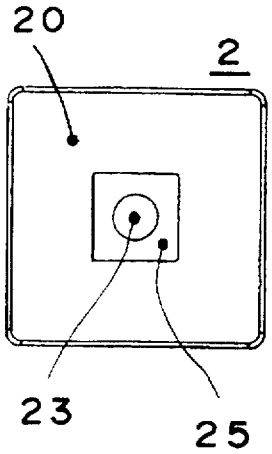
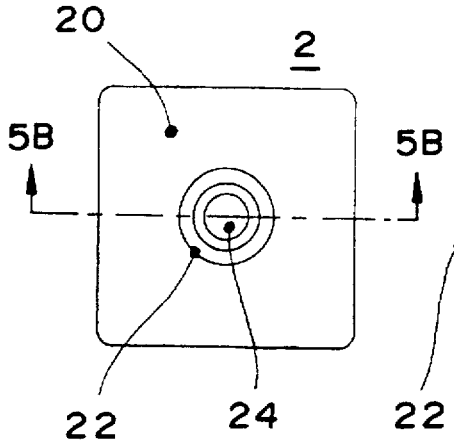
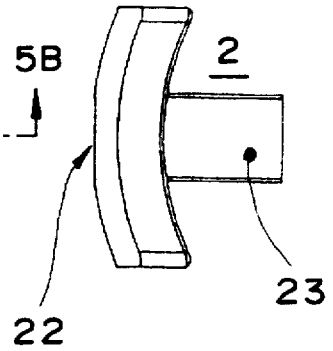
FIG. 5E FIG. 5C FIG. 5D FIG. 6A
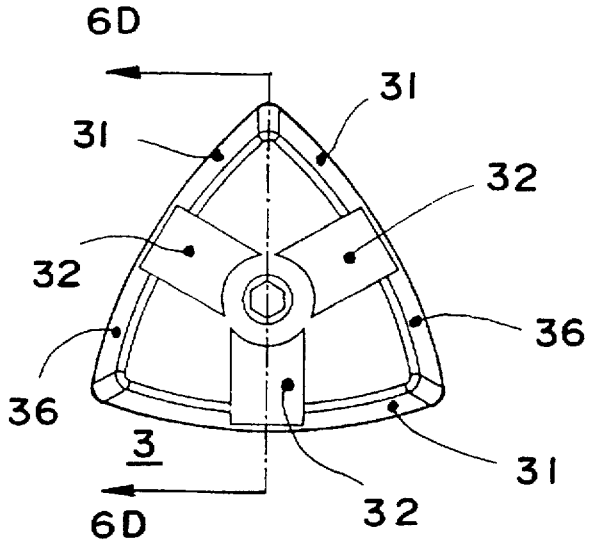
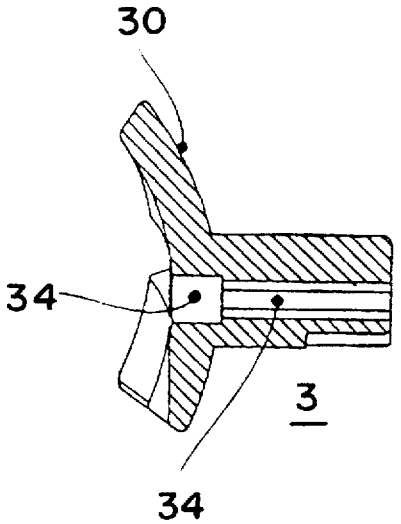
FIG. 6D
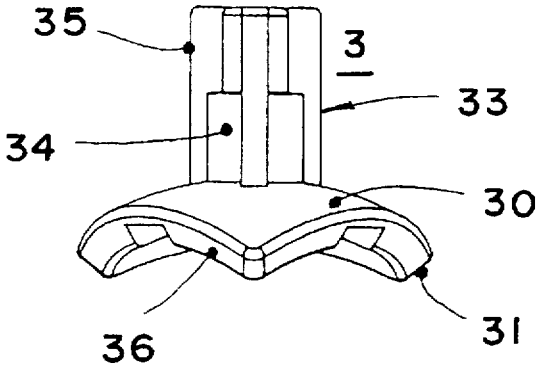
FIG. 6B
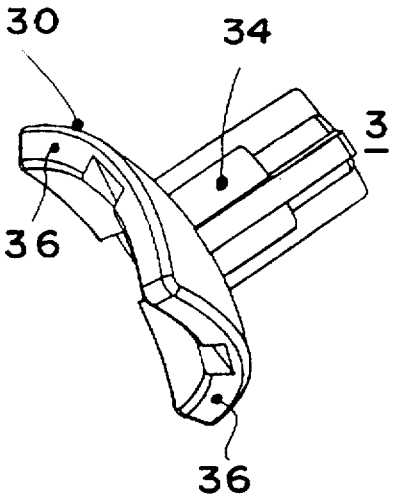
FIG. 6E
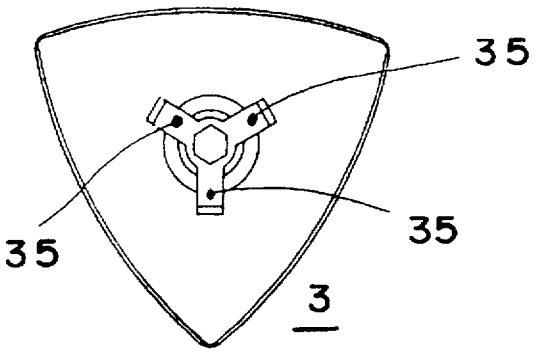
FIG. 6C FIG. 7A
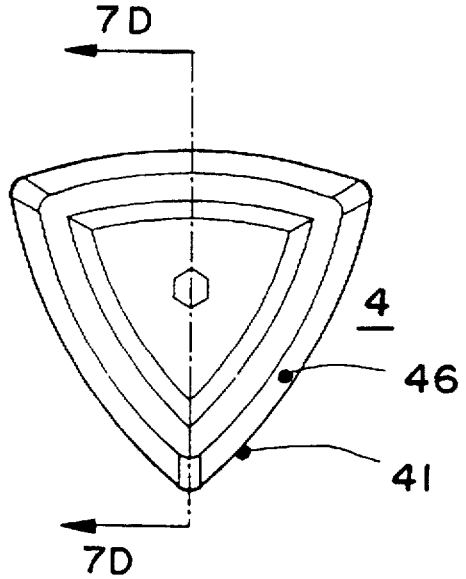
FIG. 7D
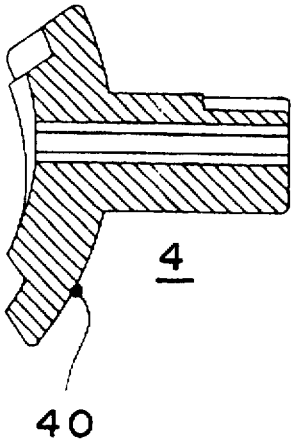
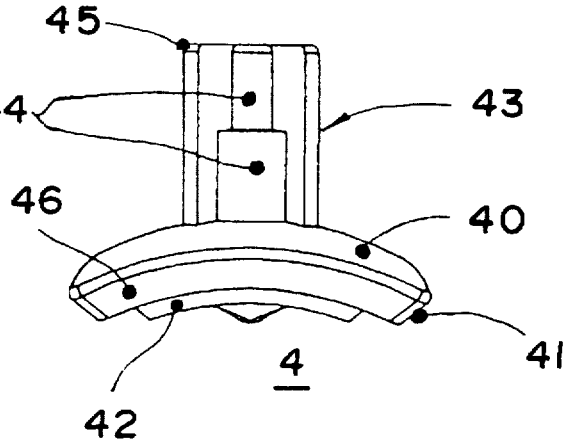
FIG. 7B
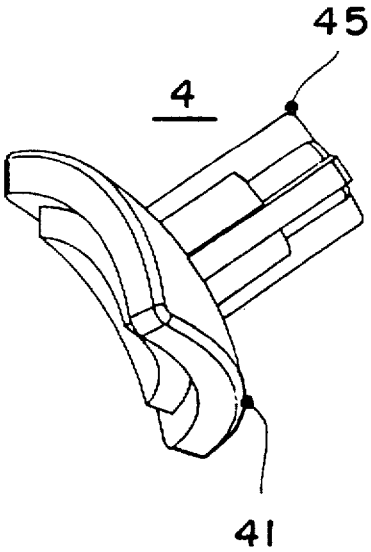
FIG. 7E
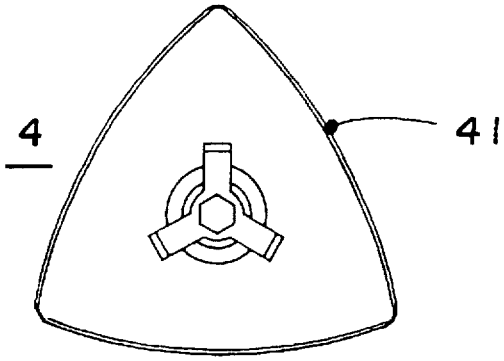
FIG. 7C

RECREATIONAL DIDACTIC MULTICOMBINABLE DEVICE

BACKGROUND OF THE INVENTION

The invention concerns a recreational didactic multicombinable device using a body, preferably a spherical or hexahedral block, subdivided in multiple areas with manually movable or relocatable elements thereon following coordinated axes and irrespective of each of the planes of the sphere or hexahedron.

The aim of the invention is the simplification of an inner structure of the toy by means of the harmonization of a series of common pieces which will invariably be the same for the different expressions or external presentations of the toy. Thus, all the internal pieces of the set are unvaried while only the external pieces or members showing the visible face of the toy will be designed and shaped with one of the parts of the "puzzle or jigsaw" configuring the set, whichever the version of the object, character, animal or item reproduced.

According to the invention, such external pieces showing the visible face of the toy will necessarily have an exact basic portion, proportional with the spherical or hexahedral nucleus of the set, more precisely, one-eighth of such for an equal basic design, and also necessarily with the same means of affixing or fastening for each of them.

STATE OF THE ART

The essential basis for the invention is based upon PCT/ES92/00066 converted into EP 9218614.6 with an international implementation number WO 94/04235 dated Mar. 3, 1994 from the same inventor, F. Josa with the result of International Investigation dated 22 Dec. 1993 as follows:

Category A: WO.A.82.00101 (Generalimpex Hungarian)

Forgian Trade Company) 21 Jan. 1982

U.S. Pat. No. , 5074562 (Green) 24 Dec. 1991

U.S. Pat. No. 4415158 (Engel) 15 Nov. 1983

EP.A. 0062395 (Wiggs) 13 Oct. 1982

The same concept provides the starting point; an internal sphere nucleus with six bracing or fastening points which are orthogonally perpendicular with each other.

A set of six identical parts to which are secured at the six previously mentioned points and which provide a guide to the support pieces.

A set of support parts equal to each other and corresponding to an exact portion of the subdivision of the spherical-hexahedral body of the set.

A set of eight support pieces of which one is fixed and seven are mobile, the first of such acting as a pivot for the orbit moves of the other seven pieces.

Eight external pieces are provided with the means for fastening at the support pieces and are moved simultaneously therewith. The external pieces define an exact portion of the set and each involves an external body portion of the object reproduced by the external pieces.

The portions, since they are proportional with the shape and volume of the nucleus and the set, will basically be of equal proportions and shape.

SUMMARY OF THE INVENTION

The idea of the invention is to offer a nucleus which generally follows the original spherical format but offers a substantially lighter structure allowing for mounting means for the guiding parts and, at several points, for the mounting of the support part acting as a pivot for the rotation of the remaining support parts.

Another idea of the invention is that the guiding parts or organs for the movement of the mobile supportive pieces are resiliently mounted, providing such pieces with a resiliently floating mounting facilitating the rotational movement and contributing to the guidance of such pieces, preventing them from leaving their mounting areas.

Another idea is that the fixed support part can be immobilized in any of the octants the invention has been subdivided into.

Another idea of the invention is providing the nucleus at one of the octants with a wedge equipped with retractable means for bump and guidance of the sliding of the mobile support pieces.

Another detail of the invention is that each of the mobile supports (seven) or fixed (one) involve pin means for assembly of the external pieces and formation of the external body of the set, such being also provided with nut means adjustable by pressure.

One of the characteristic details of the invention is that the aforementioned nucleus spherical hexahedral is a semi-hollow, light body, orthogonally subdivided into six coordinated planes perpendicular to each other, combined in sets of two parallel panels equidistant from each other and thus delimitating six prismatic locations diametrically opposed for bracing as well as eight-triangle-spherical (octants) sectors with eight unused hollow spaces within such set of sectors.

Another detail of the invention is that the six prismatic locations for bracing are partially blind sockets have a square section slightly truncated towards the bottom which contains a blind bore for location, for instance, of a screw or bolt for fixation of the guidance organs for the support mobile pieces.

A distinctive feature of such organs is that they are mobile "T"-shaped parts with square-shape head and a spherical profile adjustable to the surface of the nucleus and a prismatic shaft which fits into nut receiving prismatic points or sockets of the nucleus and is axially equipped with a stepped bore for location of a shaft which will be fixed at the lower portion thereof into the blind bore of each prismatic location of the nucleus.

A distinctive attribute to the shaft of the fixation means of the guidance organs is that it is provided with a mixed profile ending in a remote end portion which will fix the shaft within the blind bore of the prismatic socket, and a seat between the head and such remote end portion for location of a spring serving as cushion for the square-shaped head of the guidance organ as it engages on the bases of the mobile parts without hampering or preventing sliding movement thereof.

A distinctive feature of the mobile support parts is they are of a one-piece body having a base or support with a spherical-triangle shape equivalent to an eighth part of the sphere, from which centrally projects a cylinder-shaped spike of regularly diminishing diameters provided with lateral extensions equidistant thereabout and acting as tongues for the mounting of the external pieces or covering parts.

Another feature of such mobile support parts is that their bases, on the lower face thereof, have three channels or radial grooves all equal and extending to the centers of the sides of the bases and allowing the guidance of the parts when moving over the retractile bumper placed on the fixed part acting as rotating pivot.

Another feature of the supporting fixed part acting as rotation pivot is it being formed similar to the mobile to support pieces but with the lower face of the base or support soleplate lacking the channels or radial offsets and formed with a concentrical rib with a shape and size equal than those of the triangle-shaped hollows of the nucleus so it will be seated into one of them in an immobile way, becoming thus the pivot organ around which the seven remaining support part s will move.

Another feature of the invention is it is equipped with a retractable condition bumper located at a point opposed to the pivot or fixed part of support, and also located and fitted into a triangle hollow of the nucleus. Such a bumper allows the stopping of the mobile support part when moving. A slight push pressure allows the part to move beyond the bumper as the bumper is retracted. The bumper rises when pressure is absent.

A distinctive feature of such bumper is it being made with a ball pressed by a spring and located into a bore with an outwardly opening mouth in a base with a triangle shape engaged by pressure into one of the triangle-shaped hollows of the nucleus, more specifically the hollow opposed to th e rotation pivot. The pressure of the spring located under the ball and contained in such nucleus triangle hollow biases the ball permanently outward; such ball, because of restricted shape of the outer mouth, will only emerge or extend out partially, for approximately a spherical third of a sphere.

Another distinctive feature of the invention is that the eight external parts of the external body are fitted by dovetail assembly (bayonet or other) into the pin jetties of the seven mobile parts and the fixed support part; such parts each form an octant of the body of the set and each, a proportional, regular or irregular, portion of the object reproduced or represented.

A distinctive feature of such external parts is that they each include a spherical triangular shield equivalent to an octant (eighth part) of the spherical set (hexahedral) of the toy, with an inner and axially extending cylindrical bushing adequately reinforced by means of radial ribs external to the bushing, the bushing being interiorly equipped with a star-shaped socket which can be assembled with the male profile of the pin jetty of the mobile and fixed parts of the support.

The external part of the shield shows a conveniently decorated portion, designed and representing the estimated reproduction of the set, whatever the object in question.

A more complete idea of the features of the invention will be appreciated when considering the drawings and detailed description following hereinafter.

A=is a plan view of the guidance organ holding a support part.

B=is a view of the section on line 3B—3B of "A".

C=is a plan view of the nucleus.

D=is a section view on line 3D—3D of "D" and showing the bumper.

FIGS. 4A–4E are views of the nucleus.

A=is a perspective view.

B=is a sectional view on line 4B—4B of "D".

C=is a side elevation view.

D=is a plan view.

E=is a sectioned view on line 4E—4E of "D".

FIGS. 5A–5E are views of the guidance organ:

A=is a perspective view.

B=is a sectioned view on line 5B—5B of "C".

C=is an upper plan view.

D=is a side elevation view.

E=is a lower plan view.

FIGS. 6A–6E are views of one of the seven support mobile parts:

A=is a lower plan view.

B=is an elevation view.

C=is an upper plan view.

D=is a section view on line 6D—6D of "A".

E=is a perspective view.

FIGS. 7A–7E are views of the fixed support part:

A=is a lower plan view.

B=is an elevation view.

C=is an upper plan view.

D=is a section view on line 7D—7D of "A".

E=is a perspective view.

FIGS. 8A–8E are views of the base for the retractile bumper:

A=is a lower plan view.

B=is an elevation view.

C=is an upper plan view.

D=is a perspective view.

E=is a section view on line 8E—8E of "C".

FIGS. 9A–9D are views of one of the eight external body parts:

A=is a lower plan view.

B=is an elevation view from one of the vertex of the part.

C=is a perspective view from the lower face

D=is a section view on line 9D—9D of "A".

Figures 10A, 10B:
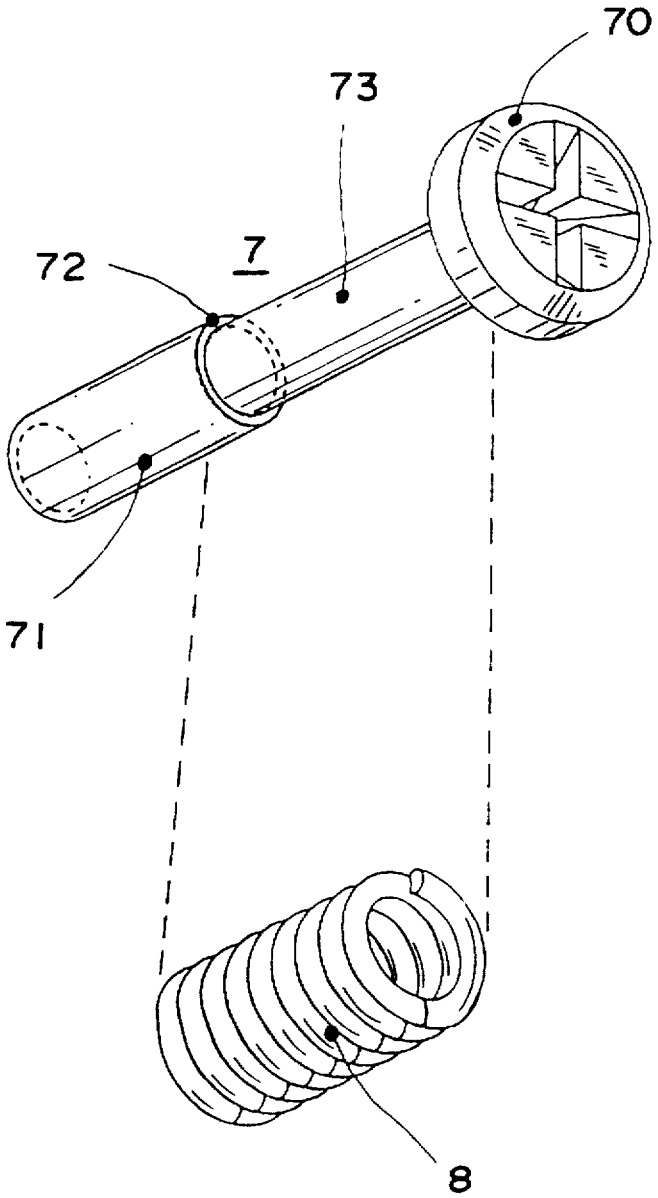

FIGS. 10A–10B are exploded views of the fastening bolt of the guidance organ:

A=is a perspective view of the bolt.

B=is a view of the spring projected from the bolt.

DESCRIPTION OF PREFERRED EMBODIMENTS

In the drawings, the spherical nucleus 1 is shown in FIGS. 4A–E; the guidance organ 2 for the mobile pieces of the support are shown in FIGS. 5A–E; such mobile pieces 3 are shown in FIGS. 6A–E; the fixed support part 4 is shown in FIGS. 7A–E; the base or wedge 50 for the retractile bumper 5 is shown in FIGS. 8A–E; an external body piece or part 6 is shown in FIGS. 9A–D; and the bolt 7 for guidance organs fastening is shown in FIGS. 10A–B.

The nucleus (FIG. 4) constituting the central organ for the development of the toy body is an integrated spherical semi-hollow body with relieved portions decreasing its mass. The nucleus is subdivided into three double parallel panels or walls (10-10*a*-10*b*) orthogonally positioned according with their coordination axis, and forming six prismatic-shaped sockets 11 for fastening the guidance organs 2 (FIG. 5); eight hollows or basins 12 with triangle-sphere shapes for receiving at least the fixed support 4 and the base 50 of the bumper 5, and six hollows or recesses 13 at the intersection of both in order to relieve the mass of the body 1.

The prismatic sockets 11 have a medium depth with bottoms provided with blind bores with screw threads or other means for the fixation of the bolt 7 therein.

Such sockets 11 mount the six guidance organs fastened by six bolts 7 and with the interposition of a spring 8 acting as a resilient retainer as shown in FIG. 3.

The guidance organ 2 (FIG. 5) is a T-shaped one-piece unit with a head 20 which is square in plan, and has a spherical-arch shape with concave arced sides 21. A prismatic vertical shaft 23 square cross-section is provided on head 20 for reception within a socket 11. The shaft has a hollow cylindrical bore with a reduced lower extent 25 of a diameter for receiving a bolt, and an upper opening with seat 22 for the head of such bolt 7.

The four sides 21 of the head 20 hold the coinciding points of adjacent bases for the mobile and fixed support parts 3, 4 and serve as guides for the moves of the mobile parts 3.

The eight mobile and fixed support parts 3, 4 have similar configurations but different functions. While the seven mobile parts 3 are manually movable on the six faces of the sphere, the remaining part 4 stays fixed, acting as a point of reference or rotation for the others.

The seven support mobile parts 3 are each integrally formed and include a base or support 30 in the shape of an arced equilateral triangle with the convex sides 31 being bevelled or chamfered toward the lower face.

Such lower face has three radial channels or offsets 32 extending towards the center of each side 31 and opening therethrough. The central intersection of the channels 32 coincides with an external perpendicular projection or jetty 33 with upwardly decreasing stepped sections 34 and with tangential and geometric ribs 35 at 120°, thus forming pin mean for assembly and fastening of the external body parts or members 6.

The fixed support 4 has parts 40, 41, 43, 44, 45 and 46 which are identical to the respective analogous parts 30, 31, 33, 34, 35 and 36 of the preceding mobile parts 3.

The lower face of the base 40 has a concentric rib 42 forming a wedge allowing the part to fit into one of the triangle-sphere hollows 12 of the nucleus 1.

The diametrically opposed hollow 12 from that mounting the fixed support 4 will receive the retractile bumper wedge or base 50. This base is shaped as an equilateral convexly arched triangle member 51 and includes inner bevelled or chamfered edges 52 to form a wedge shape for reception into the triangle-sphere hollows of the nucleus. The arched base 50 is also provided with a central bore 53 whose upper opening 54 is tapered and restricted.

The bore 53 receives a ball 9 pressed by the spring 10 with the ball emerging partially through the restricted mouth 54 to form a semi-sphere projection.

The pin jetties 33 of the seven mobile support parts 8 and the pin jetty 43 of the fixed support part 4 provide a base for the mounting of the eight external body parts 6 which will shape the external body of the device or toy itself.

The external parts 6 are basically equal. They are all formed with equilateral triangle and arc-spherical bases 60 which correspond to an octant of the external development of the spherical toy body. Its arched convex edges 61 are inwardly bevelled as at 62. Internally and centrally of each base 60 is an extension radially reinforced with external ribs 64 at 120° for assembly with the jetties 33, 43 of the support parts 3 and 4. A pin and nut assembly system may be used.

The external parts of the body 6 includes an external portion 66 of the object to be represented. Such portion illustrated in FIGS. 9A–D shows the "ear" of an animal head.

The bolt 7 mounts the guidance organ and includes a shaft equipped with a head 70. An opposed screw-threaded area 71 and a reduced neck 73 therebetween forming a seat 72 spaced from the head and receiving a spring 8 to resilient bias the head 20 of the guidance organ 2 inwardly relative to the nucleus.

The structure of the nucleus 1 provides the base for the mounting of the remaining components with the volume or overall shape of the whole assembly having the same spherical shape of the nucleus or any other polyhedral shape geometrically equivalent.

Figure 1:
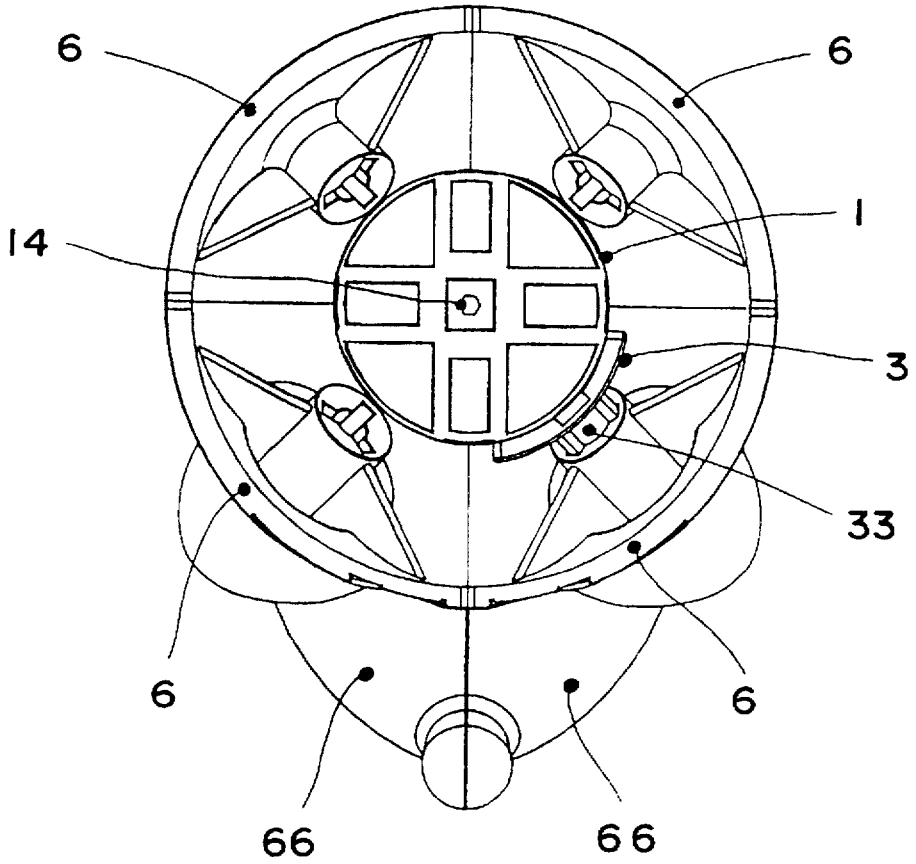
FIG. 1 is a perspective view of the spherical set of the toy in section.
Figure 1A:
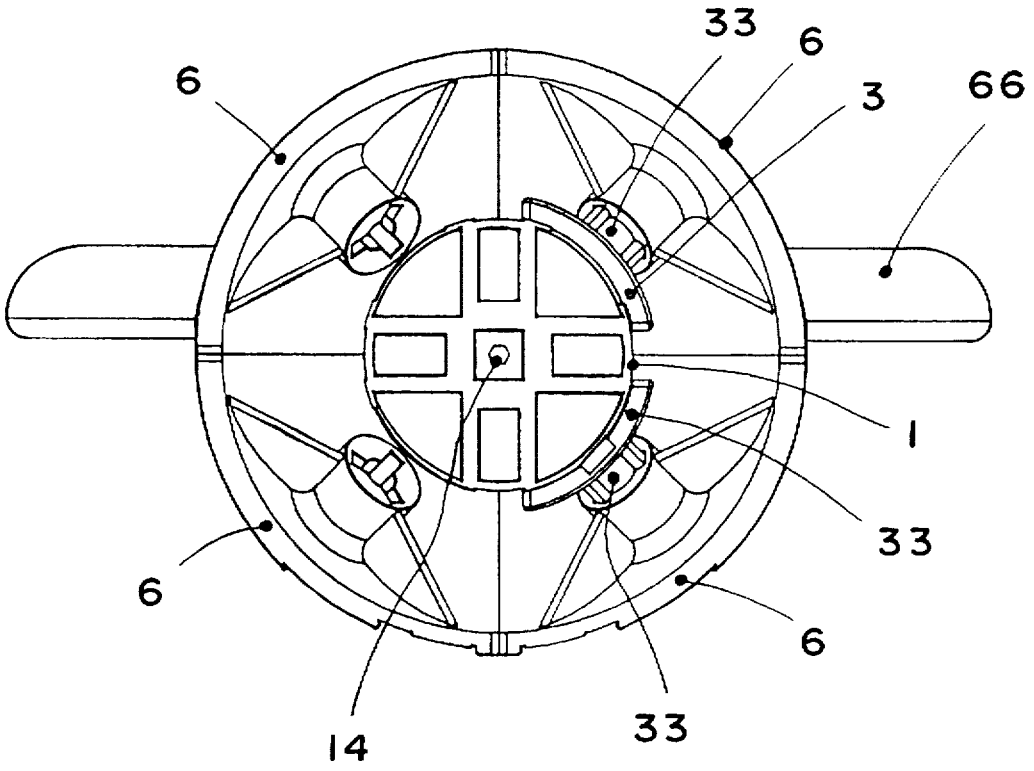
FIG. 1A is a view equal to the preceding one but from the opposed side.
Figure 2:
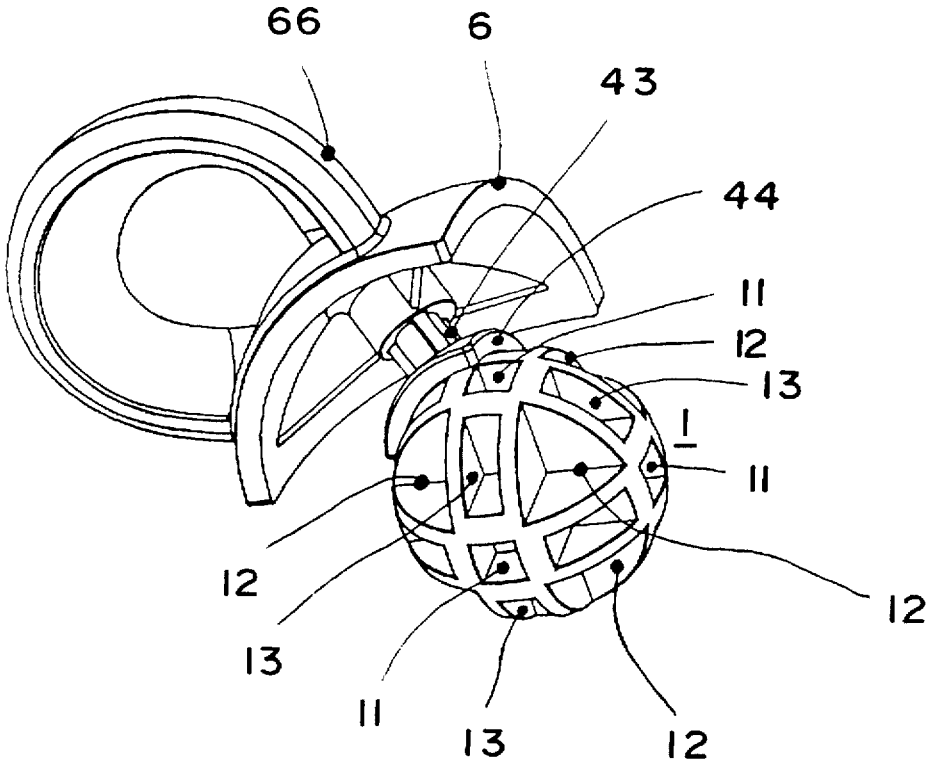
FIG. 2 is a perspective view of the nucleus with one of the support parts engaged with one of the external parts.
Figure 3A:
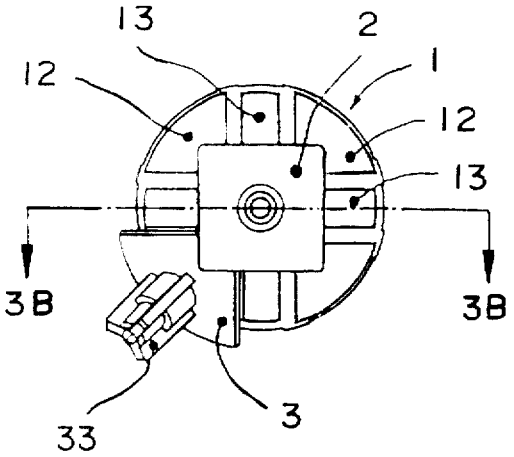
FIGS. 3A—3D are a series of views of the guidance and retractile organs of the set.
Figure 3C:
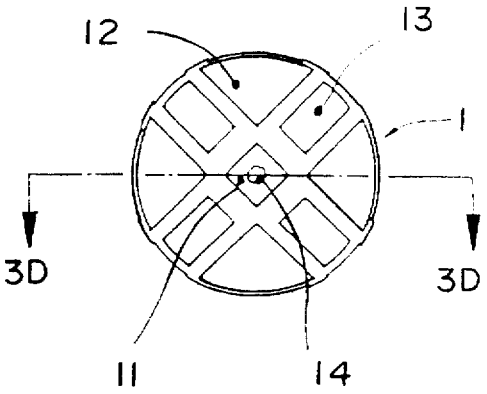
Figure 3B:
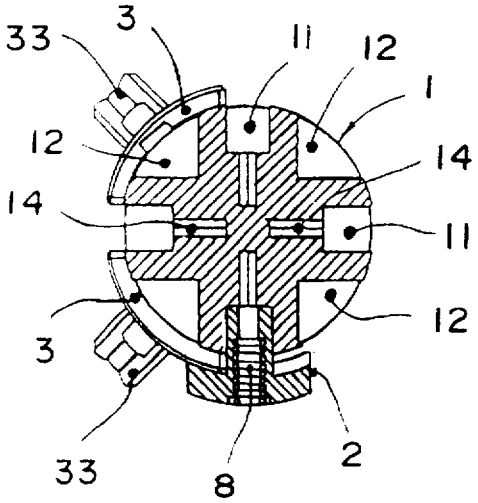
Figure 3D:
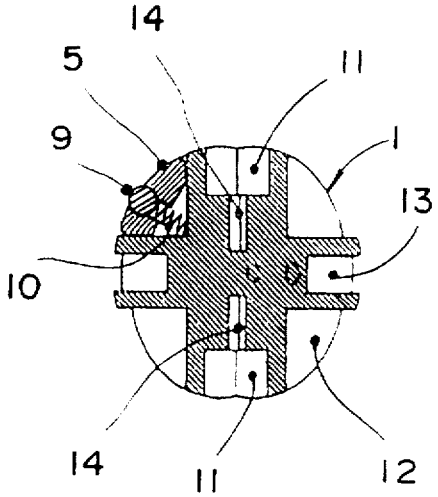
Figure 4B:
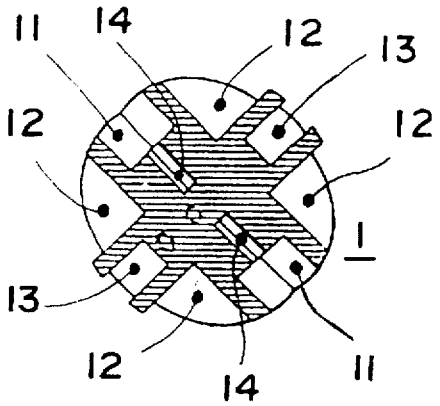
Figure 4A:
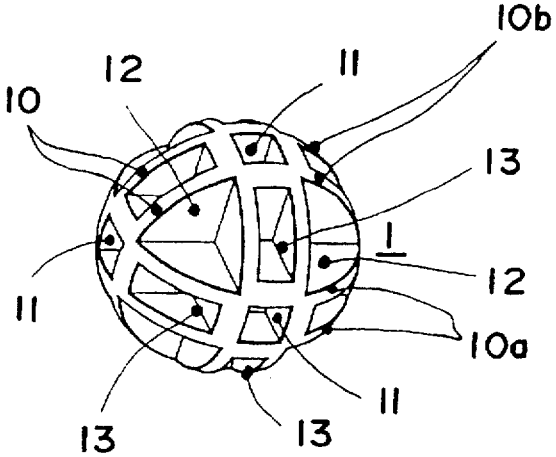
Figure 4C:
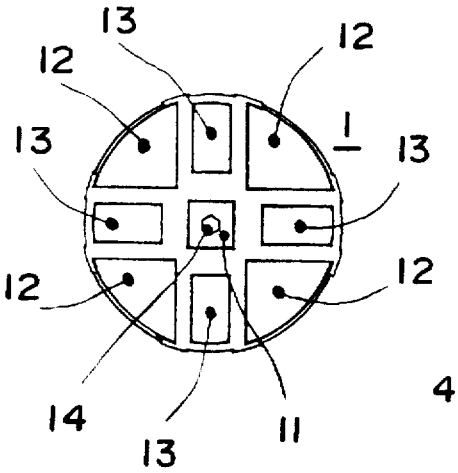
Figure 4D:
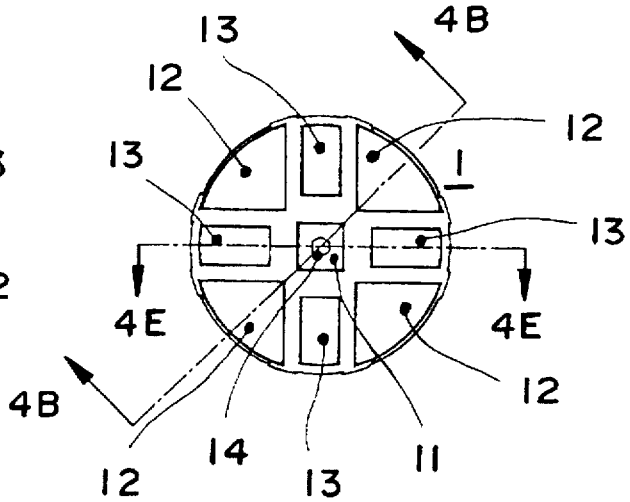
Figure 4E:
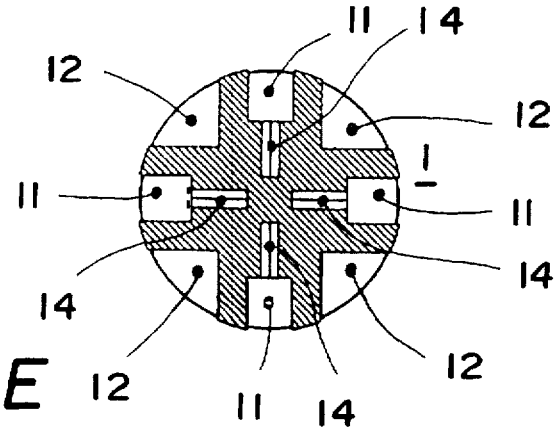
Figure 8A:
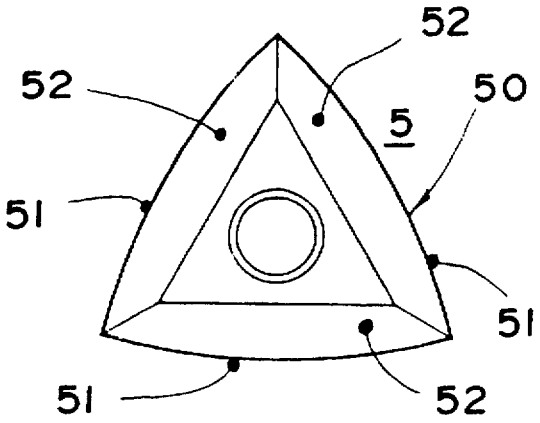
Figure 8D:
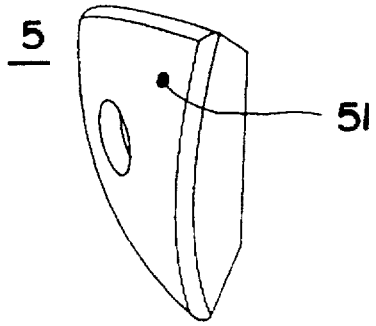
Figure 8B:
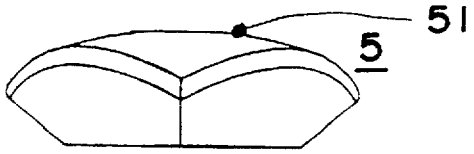
Figure 8C:
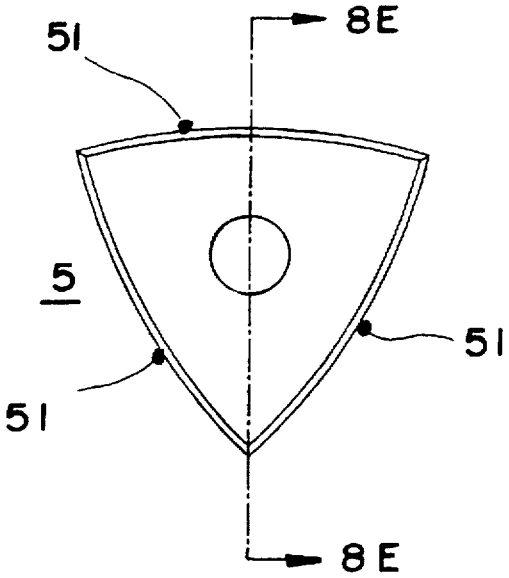
Figure 8E:
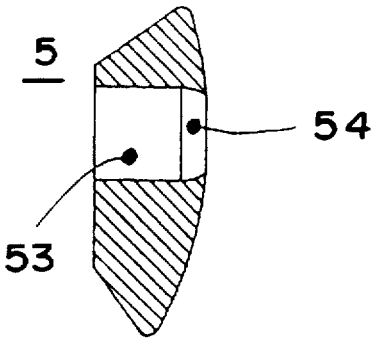
Figure 9A:
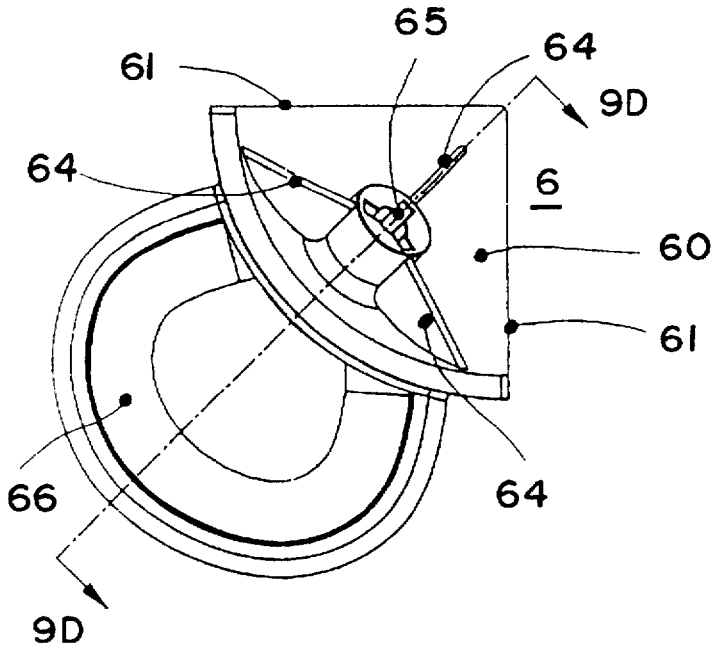
Figure 9B:
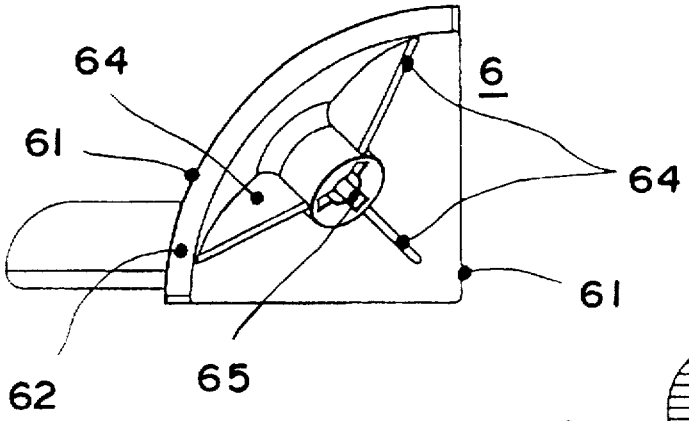
Figure 9D:
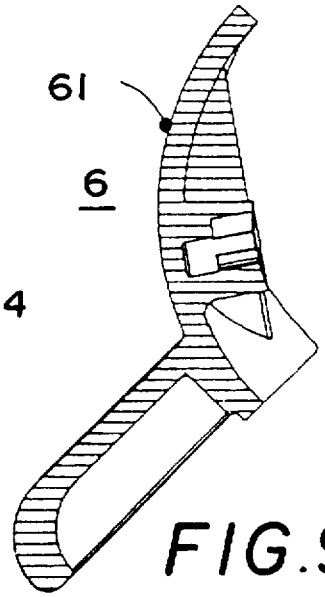
Figure 9C:
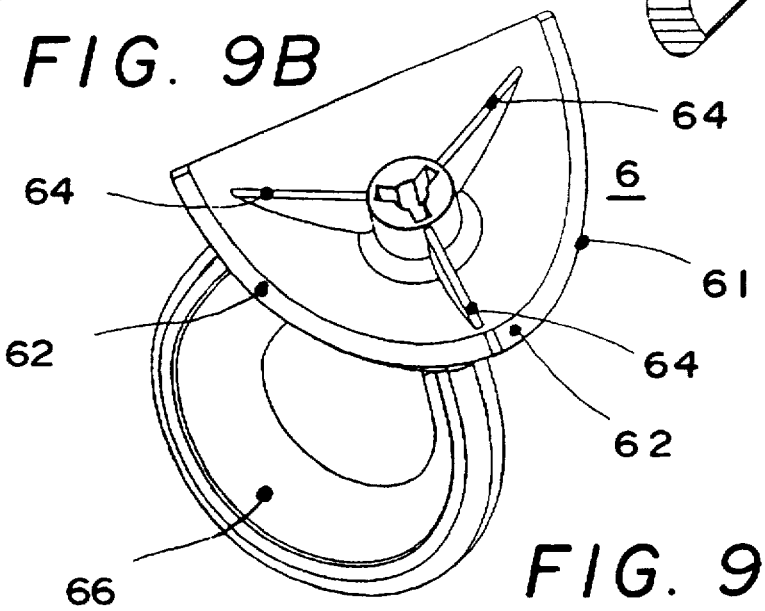

The sockets 11 serve as the mounting means for the six guidance organs 2 by means of the bolts 7 with the springs 8 (FIG. 2). Each side 21 of the head 20 of such organs overlies simultaneously two adjacent vertex portions of the bases 30, 40 of the fixed and mobile supports 3, 4.

The seven mobile supports 3 are mounted on the nucleus surface 1 so as to be manually movable thereon.

Each of the triangle-shaped hollows or recesses 12 in the spherical nucleus 1 can serve for the mounting of the fixed support part 4 so as to be immobile. The opposed hollow 12 serves for the mounting of the retractable bumper wedge 5 with the ball 9 and the spring 10.

Once the inner elements of the toy are assembled on the nucleus, such are covered with eight equal external octants 6 assembled by engaging the jetties 33, 43 of the support parts 3, 4, thus forming the external body about the nucleus.

The mobile nature of the seven parts 3 allows them to be moved in the three directions 10, **10*a*, 10*b*** in which the nucleus is orthogonally split.

The fixed part 4 provides a rotation pivot for the mobile parts 3. The bumper 9 allows control of the turning of the mobile parts with these parts being redirected by means of the radial channels 32 of the mobile parts 3. Such moves allow the external parts 6 to be properly located to form the object to be reproduced by the toy. A certain skill, vision and mathematic sense is required in order to attain such moves quickly and efficiently.

The invention is not limited to the exact details herein described but rather is intended to encompass all embodiments of the invention as fall within the scope of the following claims.

I claim:

1. A recreational didactic device including a nucleus on which is mounted a set of eight octantal support parts of which seven are mobile and one is fixed, said support parts having means for mounting eight external members surrounding the nucleus and defining a predetermined object;

said nucleus (1) being of minimal mass and subdivided by three diametric structures (10, **10*a*, 10*b*) perpendicular to each other, said structures intersecting each other at six equally spaced attachment points (11), eight triangular hollows (12) defined laterally between said structures and eight blind hollows (13) defined along said structures, six guidance organs (2) fixed on the attachment points, said seven mobile support parts (3) and said fixed support part (4) being selectively guided and retained on the nucleus by the guidance organs, said support parts being equipped with pin means (33, 43**)

externally directed relative to the nucleus for receiving the eight external members (6), each external member being generally equivalent to an octant of a defined predetermined object, and a retractable bumper element (5) mountable on the nucleus diametrically opposed to the position of the fixed support part.

2. The recreational didactic device of claim 1 wherein each of said diametric structures is defined by two parallel panels, said attachment points, at the intersecting of said structures, comprising polygonal sockets, said sockets having bottoms, and fastener means engaged between each guidance organ and an associated socket bottom for securing said guidance organs to said nucleus at said sockets.

3. The recreational didactic device of claim 1 wherein said nucleus is spherical and said attachment points are sockets (11), each guidance organ being of a general "T" configuration with a square head configured as a spherical arch with concave sides and a hollow shaft fixed to said head and depending therefrom for reception within a socket.

4. The recreational didactic device of claim 3 including fastener means engaged with each guidance organ through said hollow shaft and extending therefrom for fixed engagement within a corresponding socket.

5. The recreational didactic device of claim 1 wherein each of said eight support parts includes a support base (30, 40) equal to an octant of a sphere and forming an equilateral triangle with arced convex sides (31, 41), said pin means each comprising a mounting projection (33, 43), said external members having recesses for receiving said mounting projections.

6. The recreational didactic device of claim 5 wherein the bases of said seven mobile support parts include lower faces with channels (32) defined therein and projecting toward and opening through the center of each base side for use as guides for the positioning of the seven mobile support parts.

7. The recreational didactic device of claim 5 wherein the base of said fixed support part includes a lower face, and a depending rib (42) on said fixed part base configured to engage within any of the triangular hollows of the nucleus.

8. The recreational didactic device of claim 1 wherein said bumper element comprises an equilateral triangular wedge (50) with convex arced beveled edges, said wedge having a larger outer face and a smaller inner face, and a central bore through said wedge, said bore having a restricted mouth opening through said outer face, a ball (9) received within said bore and extending partially through said mouth, and a spring (10) received in said bore and resiliently biasing said ball toward said mouth where it seats and inwardly retracts in response to pressure of the mobile support parts moving thereover.

9. The recreational didactic device of claim 5 wherein each of said external members includes an octant shaped base (60) with convex arced and beveled edges, each external member base having a hollow outwardly opening stub (63) radially reinforced with projecting ribs for selectively receiving the pin means of the support parts, said external member bases having, mounted thereon, portions of the object to be defined.

10. The recreational didactic device of claim 4 wherein each of the fastener means comprises an elongate bolt having opposed end portions, one end portion being threaded for engagement within a socket of the nucleus, the second end portion having a head thereon engaging an associated guidance organ, and a tension spring engaged about said bolt between the bolt end portions.

11. The recreational didactic device of claim 2 wherein each of the fastener means comprises an elongate bolt having opposed end portions, one end portion being threaded for engagement within a socket of the nucleus, the second end portion having a head thereon engaging an associated guidance organ, and a tension spring engaged about said bolt between the bolt end portions.

12. The recreational didactic device of claim 1 wherein each of said external members includes an octant shaped base (60) with convex arced and beveled edges, each external member base having a hollow outwardly opening stub (63) radially reinforced with projecting ribs for selectively receiving the pin means of the support parts, said external members having bases with portions of the object to be defined mounted thereon.

13. In a recreational didactic device, a nucleus comprising three dual wall structures orthogonally intersecting each other at six points, each dual wall structure comprising a pair of parallel laterally spaced walls which, at said points of intersection, define polygonal sockets, said walls having outer peripheries defining the outer surface configuration of said nucleus, said dual wall structures defining, therebetween, eight equal polygonal recesses, each dual wall structure, between said sockets at said intersecting points, defining elongate sockets between the walls thereof.

* * * * *